United States Patent [19]

Caldwell et al.

[11] Patent Number: 4,711,299

[45] **Date of Patent: * Dec. 8, 1987**

[54] APPARATUS AND METHODS FOR PUMPING SOLIDS AND UNDESIRABLE LIQUIDS FROM A WELL BORE

[75] Inventors: Donald B. Caldwell, Enid; Robert J. Spring, Oklahoma City, both of Okla.

[73] Assignee: The Adaptable Tool Company, Oklahoma City, Okla.

[ * ] Notice: The portion of the term of this patent subsequent to Nov. 11, 2003 has been disclaimed.

[21] Appl. No.: 929,397

[22] Filed: Nov. 10, 1986

Related U.S. Application Data

[63] Continuation-in-part of Ser. No. 750,050, Jun. 26, 1985, Pat. No. 4,621,693.

[51] Int. Cl.[4] ..... E21B 37/00

[52] U.S. Cl. ..... 166/105.1; 166/311; 166/107; 417/522; 175/213

[58] Field of Search ..... 166/301, 311, 107, 109, 166/99, 105.1, 105.2, 105.3, 105.4; 175/213; 285/922; 417/522

[56] References Cited

U.S. PATENT DOCUMENTS

| | | | |
|---|---|---|---|
| 1,300,346 | 4/1919 | Church | 166/109 |
| 1,777,481 | 10/1930 | Black | 285/922 |
| 2,099,877 | 11/1937 | Westall | 166/109 |
| 2,141,672 | 12/1938 | Taylor | 166/109 |
| 2,242,551 | 5/1941 | Staerker | 417/522 |
| 3,406,757 | 10/1968 | Baumstimler | 166/99 |
| 3,651,867 | 3/1972 | Baumstimler | 166/99 |
| 3,697,194 | 10/1972 | Holmes | 166/109 |
| 4,190,113 | 2/1980 | Harrison | 166/311 |
| 4,421,182 | 12/1983 | Moody et al. | 166/105.1 |
| 4,478,285 | 10/1984 | Caldwell | 166/105.1 |
| 4,493,383 | 1/1985 | Williams et al. | 166/105.1 |
| 4,505,341 | 3/1985 | Moody et al. | 166/105.1 |

*Primary Examiner*—George A. Suchfield
*Assistant Examiner*—Bruce M. Kisliuk
*Attorney, Agent, or Firm*—William R. Laney

[57] ABSTRACT

An apparatus and methods for removing sand and debris from a well bore utilizes an elongated string which includes a pump functioning to pump debris into the string interior from the lower end of the well bore. The pump includes a stationary hollow piston with a hollow piston rod which is connected to the lower portion of the string, and a cylinder which is connected to the upper portion of the string. The cylinder is keyed to the piston rod to transmit rotary motion from the upper portion of the string via the pump to a lower portion of the string in which the debris is trapped. Check valves are provided below and above the pump in the string to prevent retrograde flow of liquid downwardly in the string. By reciprocating the upper portion of the string, debris is pumped into the lower portion of the string, along with well liquids. The liquid pumped into the string from the well continues upwardly in the string, passing through the interior of the piston rod and piston and into the pump cylinder. The upper portion of the string selectively receives either a ported sub or a continuous unported sub so that, depending upon the sub utilized, the liquid can be recirculated back into the annulus surrounding the string within the well bore, or can be pumped to the surface.

6 Claims, 9 Drawing Figures

APPARATUS AND METHODS FOR PUMPING SOLIDS AND UNDESIRABLE LIQUIDS FROM A WELL BORE

RELATED PATENT APPLICATIONS

This application is a continuation-in-part of U.S. patent application Ser. No. 750,050 entitled "APPARATUS AND METHOD FOR PUMPING SOLIDS AND UNDESIRABLE LIQUIDS FROM A WELL BORE", filed June 26, 1985, now U.S. Pat. No. 4,621,693.

BACKGROUND OF THE INVENTION

1. Field of the Invention

This invention relates to apparatus and methods by which undesirable materials can be removed from the lower portion of a well bore, such undesirable materials including sludge, plugs, contaminated or corrosive water and sand.

2. Brief Description of the Prior Art

Sand pumps have long been used to remove sand and other solid debris from wells. Such pumps are lowered into the well on a wire line and are operated by connection of the wire line to a piston rod. The wire line is reciprocated to operate pump. Check valves are provided in the sand pumps to prevent retrograde flow back into the well during the lifting stroke of the pump. A wire line operated sand pump is limited because of the limited motion which can be imparted to the pump through the flexible wire line.

Another type of down hole tool for capturing sand, fish, propping solids and contaminated liquids is that which is described in U.S. Pat. No. 4,190,113 to Harrison. The Harrison tool is operated by a rigid string extended to a pumping device from the surface and used to impart both rotary and reciprocating movement to the tool. A pump is incorporated in the elongated string extended downwardly into well bore from the surface, and is operated by reciprocating the upper portion of the elongated string to cause liquid and solid debris to pass into the lower portion of the tool. Here the solid portion of the debris is trapped due to density difference and the liquid portion continues to move upwardly during the pumping stroke. The liquid passes through the piston, and is pumped through ports located above the piston and communicating with the annulus around the tool. In this way, the liquid is returned to the well bore after the solid debris has been separated therefrom.

The tool described in the Harrison patent is characterized by a less than optimum service life because, where corrosive liquids are pumped from the well bore, the liquid surrounds the piston rod and contacts the cylinder walls causing corrosion thereof and early weakening. Further, in returning the pumped liquid to the well bore, the Harrison tool makes no provision for those cases where the liquid is so caustic or corrosive that it would be desirable to remove it entirely from the well by pumping it or removing it to the surface.

The Harrison tool is also susceptible to high pressure gas unloading of the debris collected in the debris retaining chamber at the lower portion of the tool. This occurs where high pressure gas is present in the well bore and develops sufficient pressure under the collected debris to force it explosively upwardly through the pump and back out of the ports which communicate the interior of the pump cylinder with the well bore. Where this occurs, the efficiency of the pump in collecting debris is obviously drastically lowered, and equally importantly, the forcing of the sand upwardly through the pump erodes the pump and valve surfaces and tends to cause fouling of the pump.

Caldwell U.S. patent application Ser. No. 342,349 describes an improved down hole tool and method of using that tool, which function effectively in the removal of either or both solid debris and corrosive liquids from the well bore, while including an effective pumping structure with a much increased operating life as compared to other similar tools. Like the Harrison tool, however, the debris removal tool described in said copending patent application includes a check valve mounted in the piston forming a part of a pump included in an elongated string which carries the tool, and such piston mounted valve is also susceptible to rapid wear due to the high velocity passage of pumped liquid upwardly in the tool. Erosion and corrosion of the valve element carried in the piston is especially pronounced where highly corrosive liquid is present in the well bore and is pumped upwardly. Further, and as compared to the present invention, where any solid particles are entrained with the liquid which passes upwardly through the hollow piston and piston rod disclosed in the copending application, a tendency exists to erode away the inlet to the hollow piston, and to damage the check valve carried therein.

GENERAL DESCRIPTION OF THE PRESENT INVENTION

The present invention provides an improved downhole tool useful for baling out the well by removing sand, dirt, trash, pieces of metal, propping agents, caustic water and other undesirable materials from the well bore. The tool is a mechanically simple device, having a minimum number of moving parts and valves susceptible to malfunctioning. The tool operates on the basis and principle of separating solids from liquids and disposing of each in an efficient manner.

Broadly described, the apparatus of the invention comprises an elongated string of metallic or other rigid structural members which are interconnected in sections and dimensioned for extension downwardly into a well bore in the earth. The string is of a length such that the location of the debris and other material to be removed from the well is reached by the lower end of the string. The string includes an upper portion which can be solid or tubular, but which has sufficient mechanical strength that both rotary and reciprocating motions can be imparted to the lower portion of the string via the upper portion. Thus, the present invention avoids the use of wire lines or other flexible members in order to attain a driving and actuating capability which permits both rotary and reciprocating movement to be imparted to a pump and cutting or reaming elements, and other structures which are included in the string in the lower portion thereof.

More specifically, the present invention comprises a series of elongated, threadedly interconnected tubular or solid rod sections extendable from the surface downwardly into the well, with the lower end of the interconnected elements connected to a tubular liquid receiving sub which is located above a tubular sub containing an upper check valve. The check valve containing tubular sub is connected by a suitable connector subassembly to the upper end of the cylinder of a reciprocating pump. The reciprocating pump further includes a stationary piston having a piston rod extending downwardly therefrom through the lower end of the cylinder and connected at its lower end to a connector section which connects the piston rod to a solids or debris collecting and retaining chamber. Connected below the solids collecting chamber in the string is a standing valve sub, and below that is a bottom sub. A bore is formed through the piston and piston rod to permit liquid to be pumped upwardly into the liquid chamber above the upper check valve. A second check valve is preferably located at the upper end of, or above, the solids collecting chamber.

In operation, the cylinder of the pump is reciprocated from the surface by means of the interconnecting elements of the string, and this causes both liquids and solids to enter the bottom sub, and then to pass through the standing valve sub and into the solids retaining chamber. At this location, the solids tend to settle out as the liquid is pumped further upwardly in the string. The liquid passes upwardly in the string through the passageway formed through the piston and piston rod and ultimately enters the liquid chamber above the upper check valve. From this point, the liquid may be ported to the annulus and thus returned to the well bore, or it may be retained until the entire tool is removed from the well, or, by continuing the pumping action, the liquid can be pumped to the surface. The connection between the upper portion of the string and the lower portion, via the pump included in the string, is such that rotation of the string at its upper end is transmitted through the string to the lower end of the string.

In one embodiment, the present invention comprises a series of elongated, threadedly interconnected tubular or solid rod sections extendable from the surface downwardly into the well, with the lower end of the interconnected elements connected to a tubular, liquid-receiving sub which is located above a tubular sub containing an upper check valve. In one form of the invention, a perforated nipple can be connected into the string between the sub containing the upper check valve and the tubular liquid-receiving sub at the lower end of the described interconnected elements.

The check valve-containing tubular sub is connected, through a handling sub, to the upper end of the cylinder of an upper reciprocating pump. The upper reciprocating pump, as will be explained, is the uppermost of two pumps which are connected in tandem in the tool string in order to provide certain advantages of operation. The upper reciprocating pump further includes a stationary piston which has a hollow piston rod, shaped as a kelly, extending downwardly therefrom through the lower end of the cylinder. The hollow piston rod is connected at its lower end through a kelly neck to a handling sub. The handling sub is in turn connected through a check valve sub to a lower reciprocating pump which is constructed identically to the upper pump, and which includes a reciprocated cylinder which moves on a stationary piston. The piston is carried on the upper end of a hollow piston rod which is in the form of a hollow kelly. The hollow kelly is connected through a kelly neck to a check valve sub. The check valve sub is connected to the upper end of a tailpipe or tubing which has a screen located in its upper end. The screen functions to block coarse debris which would otherwise tend to pass upwardly into the lower reciprocating pump. Below the tailpipe or debris holding tubing in the string is a check valve sub which has its lower end connected through a safety joint to at least one lower check valve sub which is located in the lower end portion of the string.

An important object of the present invention is to provide a well clean out tool which, by reason of its construction, prevents dumping of the liquid and solid load which has been pumped as a result of the occurrence of a build up in gas pressure at the lower end of the clean out tool.

A further object of the invention is to provide a method and apparatus for removing debris from the lower end of a well bore in such manner that the solids can be isolated and the liquids optionally either returned to the well bore or pumped to the surface.

A further object of the invention is to provide an improved well clean out tool which employs a minimum number of valves located so that the valves are susceptible to minimal fouling and erosion over an extended service life of the tool, and so that the few valves used are readily accessible.

An additional and further object of the invention is to provide a well clean out tool which can be manipulated from the surface in a reciprocating, as well as in a rotary motion, so as to prevent sticking of the tool, and to permit the tool to be used for reaming and other secondary operations and functions, in addition to its well clean out function.

Another object of the invention is to provide a well clean out tool which does not require the inclusion of any feathering sub in the lower portion of the string.

Another important object of the invention is to provide a tandem pump assembly employing two pumps connected in tandem in a downhole well cleanout tool of the type described, so that the cleanout which could be effectively accomplished with a single pump can be accomplished two to three times faster with the assembled dual pumps connected in such tandem array.

Another object of the invention is to double the capacity of the downhole cleanout tool of the invention in terms of its ability to pump fluid to the surface and to accumulate solid debris, all without enlargement of the diameter of the tool over that which characterizes a single pump system.

Another object of the invention is to provide a safety joint by which the lower end of the tool string below a lower check valve sub can be disconnected by simply turning the string to the left. The tailpipe or debris holding tubing can then be pulled out of the well, enabling a clean fish to then be accomplished to recover the bottom hole assembly.

A further object of the invention is to provide a dual pump, tandem-connected downhole cleanout assembly which can be broken into relatively light weight sections, and can be quickly assembled for use in pumping large heads of liquid to the surface in certain well cleanout operations.

Other objects and advantages of the invention will be become apparent as the following detailed description of the invention is read in conjunction with the accompanying drawings which illustrate certain preferred embodiments of the invention.

GENERAL DESCRIPTION OF THE DRAWINGS

FIG. 1 is a partial, front elevational view of one embodiment of the present invention as it appears when operatively disposed in a well bore.

FIG. 2, which is subdivided into parts labeled as FIGS. 2A and 2B, is an enlarged, exploded view, partially cross-sectioned along a central vertical plane through the apparatus shown in FIG. 1. FIG. 2A is the uppermost portion of the tubing string used in the apparatus, and FIG. 2B is the lowermost portion of that tubing string.

Figure 7A:
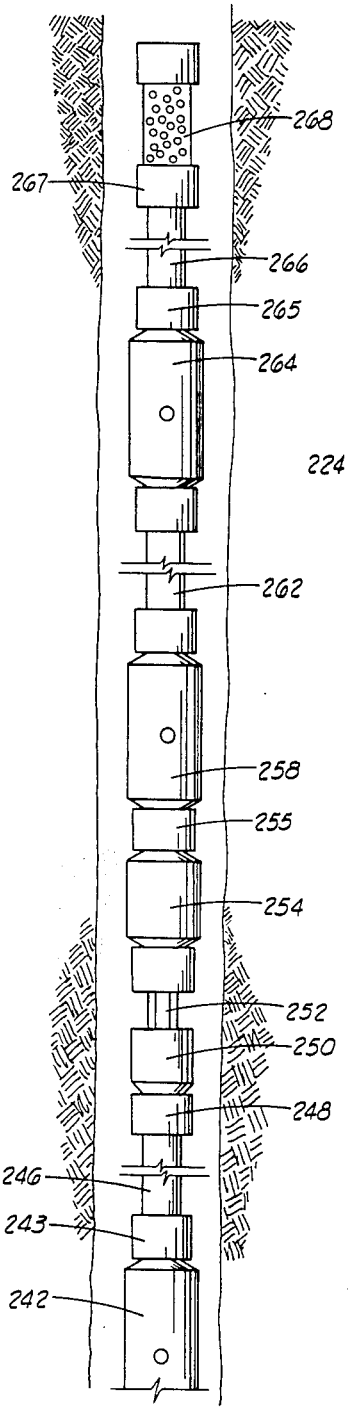
Figure 7B:
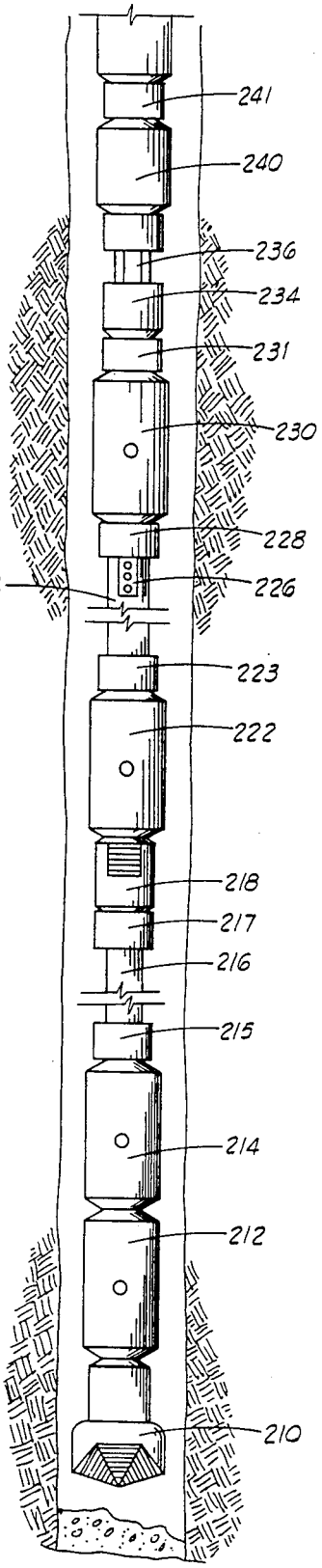

FIG. 7, which is made up or constituted by parts 7A and 7B, is an enlarged side elevation view of a modified embodiment of the invention showing, in FIG. 7A, the uppermost portion of the tubing string used in the modified embodiment of the invention, and showing, in FIG. 7B, the lowermost portion of the tubing string used in the modified embodiment of the invention.

DESCRIPTION OF PREFERRED EMBODIMENTS OF THE INVENTION

Figure 1:
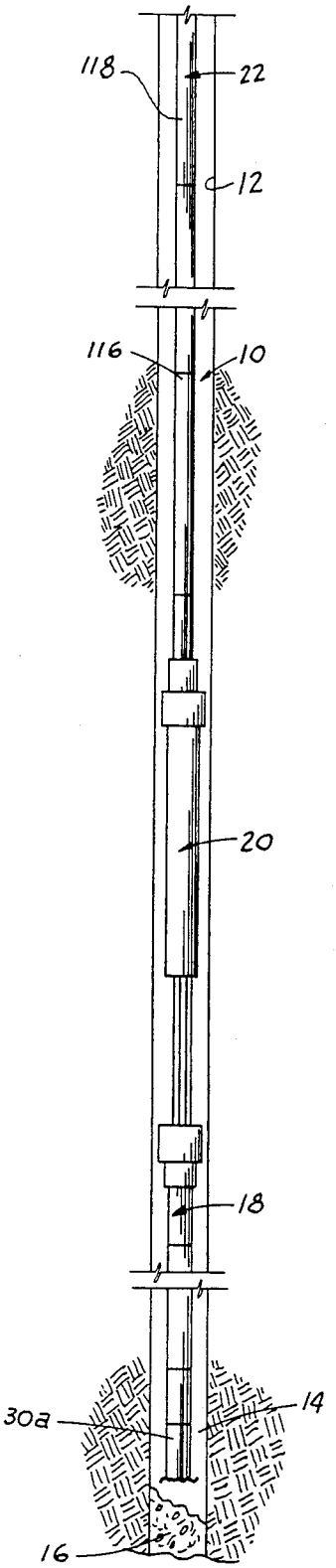

Referring to the drawings, a generally tubular relatively rigid string 10, shown in FIG. 1, is positioned within a well 12. The upper end of the string 10 is connected to a conventional surface workover rig (not shown) for axially reciprocating the string in the well 12, and for rotating the string about its vertical axis. The string has a down hole end 14 located adjacent solid well debris 16. The string 10 includes a debris retaining portion or chamber 18, a pumping portion 20 and an upper portion 22 connectable to a surface rig (not shown).

Figure 2A:
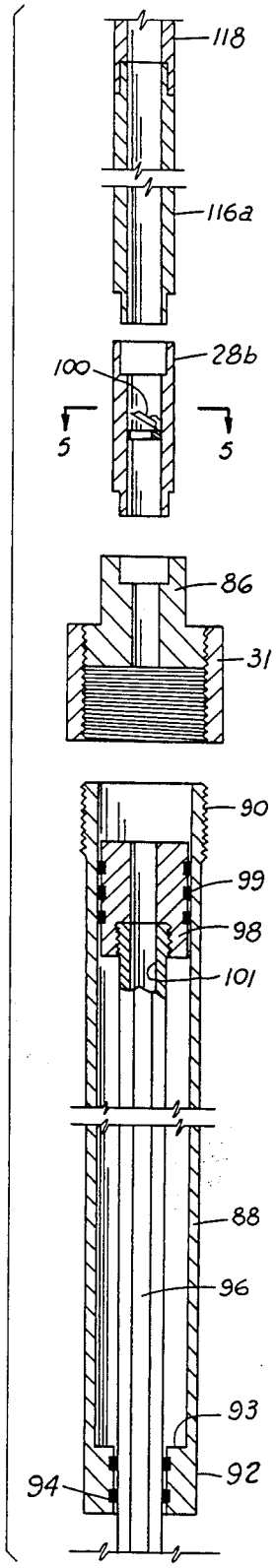

As shown in FIG. 2, the debris retaining portion 18 includes a feathering sub 24, a solid debris collecting sub 26, a standing valve sub 28*a*, and a debris engaging bottom sub 30. Each of the subs 24 through 30 is threadedly connected to its adjacent sub to enable selective arrangement, removal, and replacement of the various subs forming the portion 18.

The feathering sub 24 includes an upper threaded collar 32 and a threaded, apertured plug 34. An elongate bore 36 extends centrally through the plug 34. The diameter of the bore 36 is considerably less than the internal diameter of the adjacent portions of the string 10.

In the tool of the present invention, the inclusion of the feathering sub 24 in the string 10 is optional, since the particular arrangement of the piston, piston rod and cylinder permits the usual functions of the feathering sub to be assumed by the hollow piston rod and piston.

The solid debris collecting sub 26 carries a pair of threaded ends 38 and 40. The threaded end 38 is securable to a threaded end of a lower check valve sub 39 which carries a check valve 41 and is connected to the threaded end 42 of the plug 34. The threaded end 40 of sub 26, is releasably securable to the threaded end 44 of the valve sub 28*a*. The column of the solid debris from the well 12 may be as long as 300 feet in length. In order to remove as much of the entire debris load as possible in a single trip into the well, the sub 26 may be up to 1500 feet in length. However, the length of the sub 26 is controlled by the amount of liquid in the well because the pumping portion 20 must be within pumping distance of the fluid column.

Figure 5:
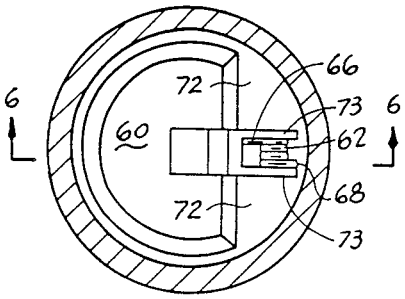
FIG. 5 is an enlarged cross-sectional view taken generally along either of the lines 5—5 in FIG. 2, the views being identical in either case.
Figure 6:
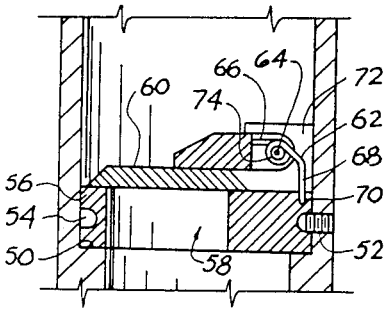
FIG. 6 is a cross-sectional view taken generally along the line 6—6 in FIG. 5.

The valve sub 28*a*, securable to the debris engaging sub 30 or by its threaded end 46 and the threaded upper end 47 of the sub 30*a*, includes a check valve 48 which permits upward flow into the string 10 and prevents reverse flow out of the string 10. The valve 48 is preferably an upwardly opening flap valve. One highly advantageous valve for this purpose, shown in FIGS. 5 and 6, is removably located within the interior of the sub 28. The valve 48 is supported on a ledge 50 formed in the interior surface of the sub 28, and is retained against upward movement by a threaded fastener 52, conveniently a conventional set screw, engaging a peripheral annular depression 54 encircling the seat of the valve 48. The seat 56 forms an opening 58 closed by a pivoting flap element 60. The flap element 60 is biased to the closed position on the seat 56 by a torsion spring 62 encircling a pin 64 that pivotally mounts the flap element 60. One end 66 of the spring 62 is secured to the flap element 60 while the other end 68 is secured within an aperture 70 in the seat 56.

Since the spring 62 is situated astride the opening 58 and over the seat 56, its exposure to liquid flow through the sub 28 is minimized. Further protection against contamination is provided to the spring 62 and pin 64 by the upwardly directed flanges 72 located to either side of the spring 62, connected to the seat 56, and by the lateral tabs 73 of the element 60 that receive the pin 64 and sandwich the spring 62 beteen themselves. A tubular bushing 74, encircled by the spring 62 as well as by the tabs 73 of the element 60, facilitates the action of the spring 62.

Figure 4:
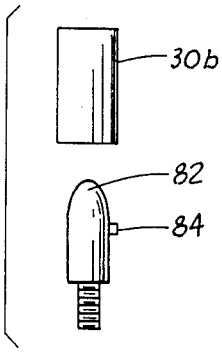
FIG. 4 is an exploded view of a fishing tool useful in connection with the embodiment shown in FIG. 1.

The debris engaging sub 30*a* includes an inlet 78 that admits water and debris 16 into the string 10. A variety of conventional debris engaging subs may be used as the sub 30*a*, depending on the intended use of the string 10. The drilling sub 30*a*, shown in FIG. 2, for example, includes a serrated lower edge 80 useful in grinding or drilling solid debris 16 to enable the particles to be sucked inwardly into the string 10. The retrieving sub 30*b* shown in FIG. 4, is useful for engaging and removing a lodged downhole fish 82 using a conventional engaging means (not shown) located in its interior. Upon downward movement and subsequent rotation of the string 10, the sub 30*b* engages and is locked onto the outwardly extending pin 84 of the fish 82. Any conventional debris engaging sub may be used in place of the illustrated subs 30*a* and 30*b* for drilling, milling, retrieving fish, collecting junk, supplying liquid, cleaning, swabbing, bailing or the like, all well known in the art.

Located atop the debris retaining portion 18, the pumping portion 20 includes connecting sub 86 and a collar 31 threadely connecting a sub 86 to the threaded end 90 of a cylinder 88. The cylinder 88 includes a threaded upper end 90 engaging the collar 31 and a lower end 92 which carries a closure plug 93. The closure plug 93 has a pair of seals 94 extending around and sealingly engaging a polygonally cross-sectioned piston rod 96 (i.e. in the form of a splinted shaft) which projects through the closure plug 93 at the lower end of the cylinder 88.

The piston rod 96 carries at its upward end, a piston element 98 which has sealing elements or piston rings 99 therearound. At its lower end, the piston rod 96 carries a threaded connector block 98 by which the piston rod is connected to the internally threaded collar 32. The collar 32 functions to connect the piston rod 96 to the plug 34. It will thus be perceived that the piston rod 96 and piston 98 are supported in stationary fashion at the upper end of the lower portion of the string which includes plug 34, the standing valve sub 28*a*, the debris collecting sub 26 and the debris engaging sub 30*a*.

It will be noted in referring to FIG. 2 that the piston 98 and piston rod 96 define a continuous elongated bore which a forms a fluid flow passageway through the entire length of the piston rod and through the piston. Further, the piston is free of, and does not contain, any check valve. It will further be noted that liquid jetting forcibly upwardly from the feathering sub 24 during the pumping operation as hereinafter described, does not impinge upon the lower face of the piston of the pump, as in the tool described in Caldwell copending application Ser. No. 342,349.

The sub 86 is connected at its upper end to an upper valve sub 28*b* which is substantially identical to the traveling valve sub 28*a* secured to the bottom of the debris collecting sub 26. The upper valve sub 28*b* thus contains a check valve 100 of the flapper type.

Reciprocation of the cylinder 88 upon the piston 96 causes fluid to be pumped from the well 12 upwardly through the debris retaining portion 18 and upwardly through the pumping portion 20 of the string. The upper portion 22 of the string includes a liquid receiving sub 116 which is threadedly connected at its lower end to the adjacent upper valve sub 28*b*, and its upper end to the remaining portion of the string 10 which, in the illustrated embodiment, is in the form of tubing 118. As illustrated in FIG. 2, the liquid receiving sub 116 may take the form of a closed cylinder 116*a* that receives liquid which passes upwardly through the cylinder 88 of the pumping portion 20. The liquid receiving sub 116*a* receives and retains liquid above the upper valve sub 28*b* which checks retrograde flow of the liquid downwardly from the liquid receiving sub. As pointed out in my copending patent application Ser. No. 342,349, the liquid receiving sub 116*a* can be replaced with a ported liquid receiving sub 116*b*, of the type shown in FIG. 3, in which case the liquid is expelled through a plurality of radial openings 120 and is thereby returned to the annulus surrounding the tool.

In the use and operation of the tool of the invention, the string 10 is first lowered into the well 12 until the lower end 14 of the string contacts debris 16 which is to be removed from the well. When the lower end 14 of the string 10 contacts the solid debris 16, the upper portion 22 of the string 10 is reciprocated by the use of conventional apparatus (not shown) located at the surface. Reciprocation of the upper portion of the string 10 is transmitted to the cylinder 88 through the sub 86 and collar 31. As a result, the cylinder 88 is reciprocated upon the piston 98. The piston 96 remains stationary, as does the piston rod 94.

Reciprocation of the cylinder 88 on the piston 98 causes suction to be created during in the upstroke of the cylinder 88 so that liquid in the well bore is drawn upwardly into the debris retaining portion 18 through the inlet 78. A substantial amount of solid debris enters the debris retaining portion with this liquid. At this time, the suction has also opened the check valve 48 in the lower valve sub 28*a*. At this same time, the upper check valve 100 is closed.

The length of the debris collecting sub 26 permits the solid materials constituting the debris to settle by gravity from the liquid concurrently drawn into the tool from the well bore, the liquid moves upwardly through the lower check valve sub 39, and continues upwardly through the feathering sub 24 where one is included in the string. As the liquid passes through the small diameter elongated bore 36 through the feathering sub 34, an upwardly directed force is applied to the string to prevent the string from being sucked downwardly into the debris and becoming stuck. The liquid continues upwardly into the elongated piston rod 96 and the liquid passes through the elongated continuous bore or passageway 101 through the piston rod and through the piston 98.

An advantage of the present invention is that the liquid which is jetted upwardly with considerable force from the bore 36 through the feathering sub 24 does not impinge upon the lower face of the piston 98 as such impingement occurs in the case of the tool illustrated and described in Caldwell copending application Ser. No. 342,349. Since this liquid can often be of a corrosive character, and frequently carries sand, or other small abrasive particles not separated out, the present construction obviates wear of the piston face and ealy loss of sealing integrity of the piston rings 99. The same advantage obtains, of course, where the feathering sub is entirely eliminated from the string.

After the cylinder 88 has been lifted upwardly by upward reciprocation of the upper portion 22 of the string 10, the upper portion 22 of the string and the cylinder 88 attached thereto are moved downwardly. Attachment of the cylinder 88 to the reciprocated upper portion of the string 10 provides a further improvement over prior tools because of the greater gravitational aid to pumping which the attached cylinder affords, as compared to a piston and piston rod. Downward movement of the cylinder 88 causes the piston 96 to force the liquid above the piston in the upper end of the cylinder to move upwardly through the sub 86 and through the check valve 100 in the upper check valve sub 28*b* which is forced open at this time. This same movement of the cylinder 88 in downward reciprocation closes the lower check valve 41 and the standing check valve 48 in the lower standing valve sub 28*a*, thereby preventing the accumulated solid debris from being ejected from the string 10 back into the well bore.

After passage through the check valve 100 in the upper valve sub 28*b*, the liquid is received into the liquid receiving sub 116*a*. Upon cessation of pumping, and/or during the upstroke of the cylinder 88, the liquid is trapped in the liquid receiving sub 116*a* due to closure of the check valve 48 in the upper check valve sub 28*b*.

Optionally, instead of using an unported liquid receiving sub 116*a* of the type illustrated in FIG. 2, a ported sub 116*b* can be included in the string 10 in order to recirculate the pumped liquid into the well bore. When contaminated liquid is pumped, and it is desired to remove it from the well, however, this may be done by employing the unported sub 116*a*, and either pumping the liquid to the surface, or allowing it to accumulate in the unported liquid receiving sub 116*a* until the entire tool, including the entrapped contaminated liquid, is removed from the well bore.

Due to the keyed cooperation of piston rod 96 (which is of ploygonal cross-sectional configuration) and the bore formed through the closure plug 93, rotary motion can be imparted to the entire string 10 from top to bottom by the use of a rotary motion developing apparatus located at the surface. Where a bottom sub 30*a* having a serrated lower surface 80 is utilized, this rotary motion will permit grinding or reaming of the debris 16, thereby making it possible to subsequently suck the debris more easily into the string 10. Alternatively, the sub 30*a* may be replaced by a fishing sub 30*b*, and the rotary motion used to engage the fishing sub with a fish, such as the fish 82 which is shown in FIG. 4. Subs having other functional capabilities can also be placed on the lower end of the string.

If a gas pocket is encountered during a debris removing operation, the contents of both the liquid receiving sub 116 and the solid debris collecting sub 26 are retained within the tool through the use of the unported sub 116*a*. The high pressure gas may blow the solid debris contained in the debris retaining portion upwardly through the pumping portion 20 to collect within the liquid receiving sub 116*a*. Since this sub is unported, however, the solid debris is prevented from returning to the bore hole. In the present invention, the passage of the debris through the pumping portion 20 is accomplished by way of the unobstructed passageway 101 through the piston rod 94 and piston 96, and in transiting this passageway, the debris does not encounter any valve which would be thereby subjected to severe erosion and possible jamming in the open position or blockage.

Either a manual or hydraulic jar can be developed using the tool of the present invention. The jar is produced by forcible contact of the closure plug 93 at the lower end of the cylinder 88 with the lower side of the piston 98 at the end of the upward stroke of the cylinder 88. The hydraulic jar is produced by pulling the closed lower end 92 of the cylinder 88 against the piston 98, resiliently stretching the string 10, and suddenly releasing this tension, thus producing a fluid surge. Such jarring actions are employed to prevent sticking of the string 10, or freeing it in the event it becomes stuck in the debris.

FIGS. 7A and 7B depict the upper and lower portions, respectively, of an elongated tubing string employed in a modified embodiment of the downhole cleanout tool of the invention. This tool is basically a tandem interconnection of dual pumps of the sort which characterizes the embodiment of the invention illustrated in FIGS. 1–6. The tandem pump connection offers a number of advantages in a cleanout operation, and these will be hereinafter alluded to, as the description of the modified embodiment proceeds.

In the modified embodiment as it is here illustrated, the lower end of the string carries a suitable conventional roller-cone bit 210. The tool can be used, as has previously been explained, for a drilling action, as well as for cleanout. In the latter case, the bit 210 is then replaced on the lower end of the tool. Alternately, a notched collar such as that shown at 78 in FIG. 2B and previously described, is used for reaming or cutting against the bottom of the well bore.

The bit 210 or a notched collar having an opening therethrough to permit debris and fluid to pass through the collar, is attached to the lower end of the string as described. When the notched collar is utilized, the debris then passes upwardly in the string through a check valve sub 212 and a check valve sub 214 connected immediately thereabove. The dual check valve subs 212 and 214 which contain suitable check valves afford a double seal in the event one of the check valves gets plugged in the open position, as can occasionally occur during operation. The system thus remains operative and can pump debris upwardly even through one of the check valves 212 and 214 is malfunctioning and is wedged in the open position. The check valve sub 214 is connected through a standard box and pin connection 215 to a spacer joint 216. The spacer joint 216 provides a tubular chamber for the retention of some of the debris pumped into the cleanout tool, and helps to protect and assure that a third check valve sub located upwardly in the string, and hereinafter described, will be likely to continue to function and operate properly.

Above the spacer joint 216 and connected thereto through a box and pin joint 217 is a left-hand release safety joint 218. The safety joint 218 functions by disengaging the portion of the string located therebelow from the portion of the string above the safety joint at a time when the upper portion is turned or rotated to the left about its axis. By locating the safety joint 218 below a third check valve sub 222 to which is it connected, then, if backing off and coming out of the hole becomes necessary at any time, release of the safety joint 218 at this point will give the operator a clean fish. This is because the third check valve sub 222 will not allow the debris collected in the tailpipe thereabove to fall out and cover the fish and make it inaccessible. Further, the weight of the string is thereby reduced at that time, thereby aiding the removal of the upper portion of the string carrying the collected debris in the tailpipe or debris-receiving tubing.

Disposed above the check valve sub 222 and connected thereto by a box and pin joint 223 is an elongated tailpipe or debris-receiving tubing 224. This tubular section can vary greatly in length. It functions to hold the debris which is pumped upwardly from the bottom of the hole, and along with the debris contained therein, functions as a weight to hold the pump piston rods in a stationary position while the pump cylinders are reciprocated upwardly and downwardly from the surface. It is desirable to run as much of the tailpipe 224 as the fluid in the hole will permit. In some instances, as much as 2500 feet of tailpipe are used, whereas in other cases, 90 feet may be sufficient. The average amount of the tailpipe utilized is about 1000 feet. At the upper end of the tailpipe or debris-receiving tubing 224, this section of the tubing string carries a screen 226 which can typically be about four feet in length and which functions to keep nylon, rubber covered ball sealers used in fracturing operations out of the pumps located thereabove, and to also screen out, and prevent the ascendency of, coarse debris which is rejected and settles by gravity into the debris-receiving tubing 224.

The tailpipe or debris-receiving tubing 124 is connected through a box and pin joint 228 to another check valve sub 230. The check valve sub 230 is connected through a box and pin threaded connection 231 to a kelly neck 234 which is substantially identical to the piston 98 hereinbefore described. The kelly neck 234 is secured to, or formed integrally with, the lower end of a tubular, hexagonally cross-sectioned hollow kelly rod 236 which is substantially identical to the kelly rod 96 hereinbefore described. The kelly rod 236 acts as a fluid passageway, and also acts as a piston rod which has a piston (not shown) carried on the upper end of the kelly rod, substantially identical in construction and configuration to the hollow piston 98 depicted in FIG. 2A, and characterizing the embodiment of the invention illustrated in FIGS. 1–6. Like the piston 98, the piston secured to the upper end of the kelly 236 carries a plurality of peripheral elastomeric seals, similar to the seals 99, for sealingly engaging the internal wall of the cylinder barrel of a reciprocating pump 240 of the type hereinbefore described. The upper end of the pump 240 is connected through a box and pin joint 241 to another check valve sub 242. The check valve sub 242 is connected through a box and pin joint 243 to an elongated handling sub 246. The handling sub 246 is provided to permit elevators and slips to be used to engage the tubing string to raise and lower portions of the string.

Figure 2B:
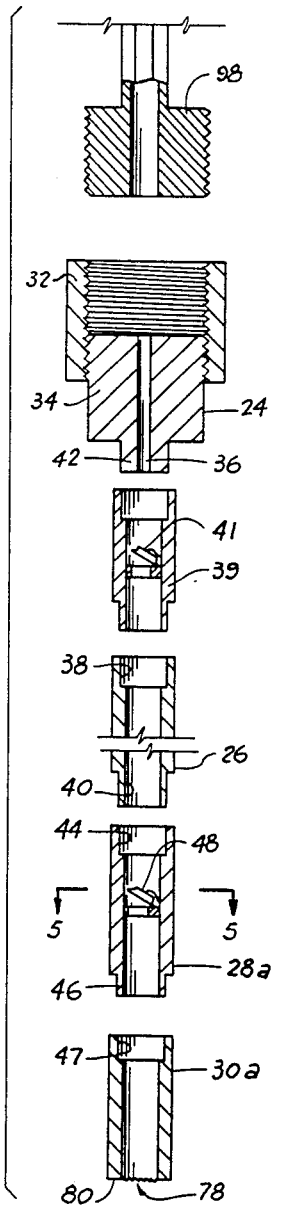
Figure 3:
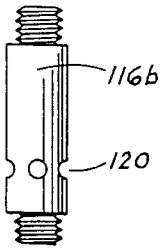
FIG. 3 is a front elevational view of a ported sub useful in the embodiment shown in FIG. 1.

The handling sub 246 is connected through a box and pin joint 248 to another kelly neck or head 250 which is substantially identical to the piston illustrated in FIG. 2B. The piston rod kelly 252 is a hollow tubular element having a hexgonal cross-sectional configuration, and is connected at its upper end to a piston (not shown) similar to a piston 98 illustrated in FIG. 2A. The piston secured to the upper end of the kelly works within the tubular barrel of an upper reciprocating pump 254. The hollow cylindrical barrel of the pump 254 cooperates with the hollow kelly 252, functioning as a stationary piston rod, and with the stationary piston carried on the upper end of the kelly, to pump fluid when the cylinder or barrel is reciprocated. The barrel of pump 254 is connected through a suitable joint 255 to a check valve sub 258 which is the lower one of a pair of upper check valves subs, 258 and 264. The check valve subs 258 and 264 are interconnected by a handling sub 262.

In the upper end portion of the cleaning tool tubing string, a perforated nipple 268 can be optionally provided. This nipple functions, when it is utilized, to permit substantially debris-free well fluid to be returned to the well bore by passing out of the perforations in the perforated nipple to the annulus which surrounds the cleanout tool. This operational mode of recirculation or return of the clean fluid to the annulus has been hereinbefore described.

In the use of the tandemly connected dual pump arrangement illustrated in FIGS. 7A and 7B, substantially double the pumping capacity can be achieved without enlargement of the diameter of the cleanout tool. Moreover, portions of the tool can be relatively quickly and easily taken apart, so as to reduce the weight of any single section or tool which must be transported and handled at any specific time. Tandemly connected dual pumps are especially effective where it is desired to pump the liquid from the bottom of the well bore all the way to the surface, as opposed to recirculating it. This is desirable in certain types of well contamination where permitting the liquid to remain in the lower end of the well bore would be deleterious.

The tandem pump arrangement also can pump fluid from the well much faster, and also can collect the debris in the bottom of the well at a faster rate. It is particularly effective in the cleanout of an old well.

The provision of a left turning safety joint toward the lower end of the tool is an advantage in the operation of the tool, since it permits a part of the tool to be left in the hole while the principal portion of the tubing string is easily removed, carrying with it, the total collected and accumulated debris.

Coarse debris and proppant materials, such as rubber coated nylon balls, used for propping in the course of fracturing, or for sealing fractures, can be excluded from fouling contact with the lowermost of the pumps by the inclusion of the screen in the string at the upper end of the tail pipe or debris-receiving tubular section, thereby preventing passage of these materials into the pump situs. The screen also prevents the bore of the tubular kelly sections from becoming clogged. This is very important where the pumps are constructed in the manner here described, and require free passage of liquid through the interior of the kelly during operation of the pump. The principal time the tandem connected pumping system is used is when it is desired to pump large volumes of liquid under a high head all the way to the surface, rather than recirculating out of the perforated nipple 68.

As previously explained, when pumping to the surface, the perforated nipple 268 will be removed from the string and replaced by an unperforated tubular section.

The tandemly connected dual pump cleanout tool has been found to be especially effective in cleaning old wells where the casing is leaking fluids from the surrounding formations. The tandemly connected tubing string can also be broken between the two sections containing the individual reciprocating pumps to permit two separate cleanout tools to be made up in those instances where such would be desirable.

Although a preferred embodiment of the present invention has been herein described in order to impart to those skilled in the art an understanding of the working principles which underlie the invention, it will be appreciated that various changes and innovations can be made in the described structure without departure from reliance on these principles. Changes and innovations of this type are therefore deemed to be circumscribed by the spirit and scope of the present invention, except as the same may be necessarily limited by the appended claims or reasonable equivalents thereof.

What is claimed is:

1. An apparatus for removing debris from a well comprising:

an elongate string connectable to a source of reciprocating and rotating motion located at the surface, the string including:

a vertically extending debris-receiving tubing portion having an outlet at the upper end thereof, and an inlet at the lower end thereof;

a debris retaining check valve sub positioned in said elongated string below said vertically extending debris-receiving tubing portion, and including a debris retaining check valve positioned to close said inlet to said debris-receiving tubing portion;

a lower downhole pump in fluid communication with the outlet of said debris-receiving tubing portion and connected to the upper end of said debris-receiving tubing portion, and including a lower pump cylinder, an apertured lower pump piston and a hollow lower pump piston rod, said lower pump piston connected by said hollow lower pump piston rod to the outlet of said debris-receiving tubing, and said lower pump cylinder retained in the string for reciprocation upwardly and downwardly around said apertured lower pump piston, and forming the upper end of said lower downhole pump;

an intermediate check valve sub connected to the upper end of said lower pump cylinder, and vertically reciprocable with said cylinder, said intermediate check valve sub including a check valve preventing retrograde flow of fluid downwardly into said lower pump cylinder;

an upper downhole pump connected to said intermediate check valve sub above said intermediate check valve sub in said string, and on the opposite side of said intermediate check valve sub from said lower downhole pump, said upper downhole pump including an upper pump cylinder and an apertured upper pump piston and a hollow upper pump piston rod, said apertured upper pump piston being connected by said upper pump hollow piston rod to the upper end of said intermediate check valve sub, and said upper pump cylinder being retained in the string for reciprocation upwardly and downwardly around said apertured upper pump piston, and forming the upper end of said upper downhole pump;

an upper portion of said string communicating with said upper downhole pump and connectable to said surface-located source of reciprocating and rotating motion on one end, and to said upper downhole pump cylinder on the other end, said upper pump cylinder being keyed to said hollow upper pump piston rod to communicate the rotation motion of said upper portion of said string via said hollow upper pump piston rod, and via said lower pump cylinder and via said lower pump piston rod keyed to said lower pump cylinder to said debris-receiving tubing located below said upper downhole pump and below said lower downhole pump;

said lower pump piston rod and lower pump piston including an internal passageway open and unobstructed from one end to the other thereof and establishing fluid communication between said lower pump cylinder and said debris retaining portion;

said hollow upper pump piston rod and apertured upper pump piston including an internal passageway open and unobstructed from one end to the other and establishing fluid communication between said upper pump cylinder and, through said intermediate check valve sub, with said lower pump cylinder of said lower downhole pump; and an upper check valve sub located above said upper downhole pump and connected to said upper pump cylinder and to said upper portion of said string for permitting flow of fluid through said last-mentioned internal passageway and through said upper pump cylinder into said upper portion of said string at a location above said upper check valve sub, and to prevent fluid flow in the reverse direction.

2. The apparatus defined in claim 1 wherein said upper pump cylinder includes a lower end which slidably engages said upper pump piston rod, and which is keyed to said upper pump piston rod for mutual rotary motion about the longitudinal axis of the upper pump piston rod whereby the rotation of said upper pump cylinder, by rotation of the string in which it is connected, will be transmitted through said upper pump piston rod, upon undergoing such mutual rotary motion, to said intermediate sub, and through said intermediate sub to said lower downhole pump; and wherein said lower pump cylinder includes a lower end slidably engaging said lower pump piston rod, and keyed to said lower pump piston rod for mutual rotary motion about the longitudinal axis of said lower pump piston rod whereby rotary motion imparted to said lower pump cylinder causes rotary movement of said lower pump piston rod to occur.

3. The apparatus as defined in claim 1 and further characterized as including a perforated sub removably connected to the upper check valve, said upper check valve in fluid communication with the passageway through said upper pump piston and upper piston rod, said perforated nipple having radial ports formed therethrough for return of pumped fluid to a wall bore around said elongated string.

4. The apparatus defined in claim 1 and further characterized as including a drilling tool connected to the lowermost end of said elongate string and below said debris-receiving tubing portion.

5. The apparatus defined in claim 1 and further characterized as including a lowermost check valve sub positioned below said debris-retaining check valve sub in said elongate string; and a safety joint positioned in said elongate string between said lowermost check valve sub and said debris-retaining check valve sub whereby the lowermost portion of said tubing string can be disconnected from the portion of said tubing string above said safety joint by release of said safety joint.

6. The apparatus defined in claim 1 and further characterized as including a perforated sub removably connected to the upper end of said upper pump cylinder and in fluid communication with the passageway through the upper pump piston and the upper piston rod, said perforated nipple having ports formed therethrough for return of pumped fluid to a well bore around said elongated string.

* * * * *

UNITED STATES PATENT OFFICE

CERTIFICATE OF CORRECTION

Patent No. 4,711,299 Dated December 8, 1987

Inventor(s) Robert J. Spring and Donald B. Caldwell

It is certified that error appears in the above-identified patent and that said Letters Patent are hereby corrected as shown below:

In the Claims:
In Column 14, line 21, delete "wall" and insert -well-.

Signed and Sealed this

Twelfth Day of April, 1988

*Attest:*

DONALD J. QUIGG

*Attesting Officer*

*Commissioner of Patents and Trademarks*